United States Patent [19]

Norberg

[11] 4,341,381

[45] Jul. 27, 1982

[54] INVALID WALKER

[76] Inventor: Kenneth H. Norberg, 1161 Butterfield Rd., San Anselmo, Calif. 94960

[21] Appl. No.: 237,243

[22] Filed: Feb. 23, 1981

[51] Int. Cl.[3] ..... A61H 3/04

[52] U.S. Cl. ..... 272/70.4; 135/67; 135/74

[58] Field of Search ..... 272/70.3, 70.4, DIG. 4; 135/65, 66, 67, 71, 72, 74, 84; 297/5, 6; D12/128, 129, 130, 133; 280/1.5, 242 WC, 278, 287, 293, 303, 639, 38, 39, 642, 643, 647, 648, 649, DIG. 4, DIG. 6

[56] References Cited

U.S. PATENT DOCUMENTS

| | | | |
|---|---|---|---|
| 3,273,888 | 9/1966 | Burns | 272/70.4 |
| 3,580,533 | 5/1971 | Nordland | 280/DIG. 6 X |

FOREIGN PATENT DOCUMENTS

| | | | |
|---|---|---|---|
| 2246227 | 8/1973 | Fed. Rep. of Germany | 280/643 |
| 1105324 | 6/1955 | France | 135/67 |
| 135040 | 11/1919 | United Kingdom | 272/70.4 |
| 832913 | 4/1960 | United Kingdom | 272/70.3 |
| 978587 | 12/1964 | United Kingdom | 272/70.3 |
| 1048148 | 11/1966 | United Kingdom | 272/70.3 |

*Primary Examiner*—Richard C. Pinkham
*Assistant Examiner*—Arnold W. Kramer
*Attorney, Agent, or Firm*—Melvin R. Stidham

[57] ABSTRACT

An invalid walker comprising a pair of interconnected upright posts having caster type wheels at the lower ends and crutch shoulder supports at the upper ends, and being adjustable in height. Trailing legs, which extend rearward and downward are pivoted to channel members extending from the posts to collapse them, and have integral stop members to engage the post to prevent over extension. A latch means on the channel member locks the trailing legs in their extended positions, but are easily released for collapsing the walker for placement in an automobile.

7 Claims, 3 Drawing Figures

INVALID WALKER

BACKGROUND OF THE INVENTION

Conventional orthopedic walkers are generally designed for people who require some assistance in walking but who are able to support their weight on their legs. However, many of the infirm do not have sufficient strength or control of their legs to enable them to use existing walkers and are, therefore, confined to a wheel chair for movement indoors and over short distances.

OBJECTS OF THE INVENTION

It is an object of this invention to provide a light weight collapsible walker which may be used by people with little leg strength.

It is a further object of this invention to provide an invalid walker for people suffering from stroke, cerebral palsy, multiple sclerosis and the like.

It is a further object of this invention to provide an invalid walker for post-operative hospital use, including support for intravenous feeding devices.

It is a further object of this invention to provide an invalid walker which is rigid and secure in use but which may be easily collapsed for storage or for carrying in an automobile.

Other objects and advantages of this invention will become apparent from the description to follow, particularly when read in conjunction with the accompanying drawing.

SUMMARY OF THE INVENTION

In carrying out this invention, I provide a pair of interconnected tubular posts having crutch shoulder supports extending rearward from the upper ends and having caster type wheels at the lower ends. A trailing leg with a wheel on the end is pivoted to each post to swing between a collapsed position along the post and an extended position wherein a trailing wheel engages the ground behind the invalid. Integral stop means on each trailing leg engages the post to prevent them from pivoting beyond their extended position and a latch on each post locks the trailing leg in position. A pair of hand grips extend rearward from each post above the trailing legs and the height of the post may be adjusted so that the crutch shoulder supports carries much of the weight of the invalid while allowing him to use his feet to propel himself.

DESCRIPTION OF A PREFERRED EMBODIMENT

Figure 2:
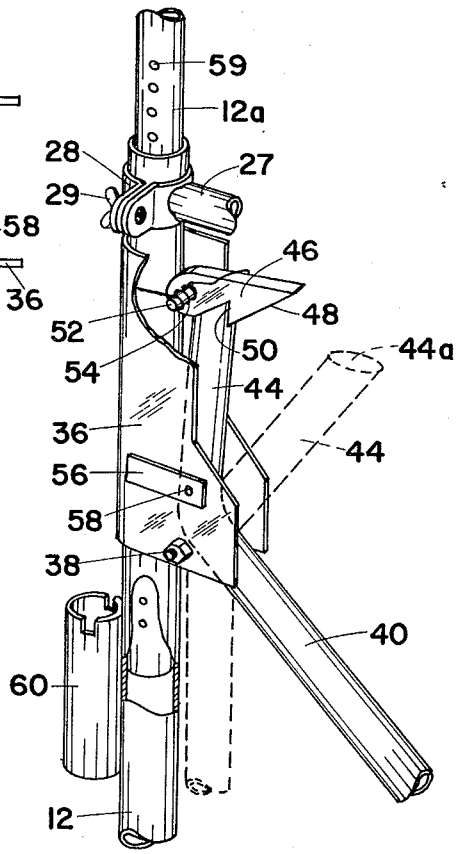
FIG. 2 is an enlarged partial view in perspective showing the height adjustment and leg collapsing features.

Referring now to the drawing with greater particularity, the invalid walker 10 of this invention includes a pair of front post or columns 12 and 14 which may, as shown, comprise the legs of a U-shaped member including an integral interconnecting bar 16 at the lower ends. The posts 12 and 14 are sufficiently flexible on the cross member 16 that their spacing may be adjusted by aligning holes 17 in telescopic cross members 18 and 20, and securing them in adjusted position by screw means 22.

An arm 24 extends rearward from the top of each post 12 and 14, and carried on each arm is a padded crutch shoulder support member 26. Also extending rearward from the posts 12 and 14 is a pair of handgrips 27, which may be secured at selected levels on split rings 28 secured by screw means 29.

Welded or otherwise secured to the lower ends of the posts 12 and 14 are rotary bearings 30 in which casters 32 carrying wheels 34 are swiveled.

A U-shaped bracket 36, which is secured to each post 12 and 14 intermediate its height has a pivot pin 38 spanning its legs to pivotally support a trailing leg 40 with a wheel 42 rotatably carried at the distal end thereof. The wheels 42 are separately mounted so that the trailing legs 40 are free of any interconnecting means rearward of the post 12 and 14. Hence, the user can move directly into the invalid walker 10 without any obstacle.

An upright stop member 44 integral with each trailing leg 40 engages against the column 12 or 14 to limit the pivotal movement of the trailing leg 40 to prevent collapse of the structure 10. A latch 46 which includes a camming surface 48 and a lock surface 50 engages over the top of the stop member 44 to prevent inadvertent collapse of the leg 40. Hence, when the leg is moved from the position shown in phantom, the top **44*a* of the stop member 44 engages the cam surface 48 to lift the latch 46 about the pin 52 and then when the surface 44*a* passes beyond the cam surface 48 a spring 54 pulls the latch 46 down over the stop member 44** to hold it firmly in place.

Figure 3:
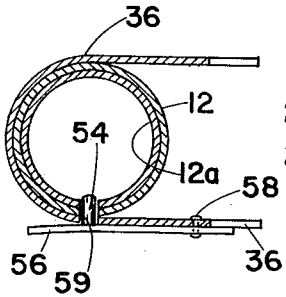
FIG. 3 is a section view through a crutch column showing the height adjustment detail.
Figure 1:
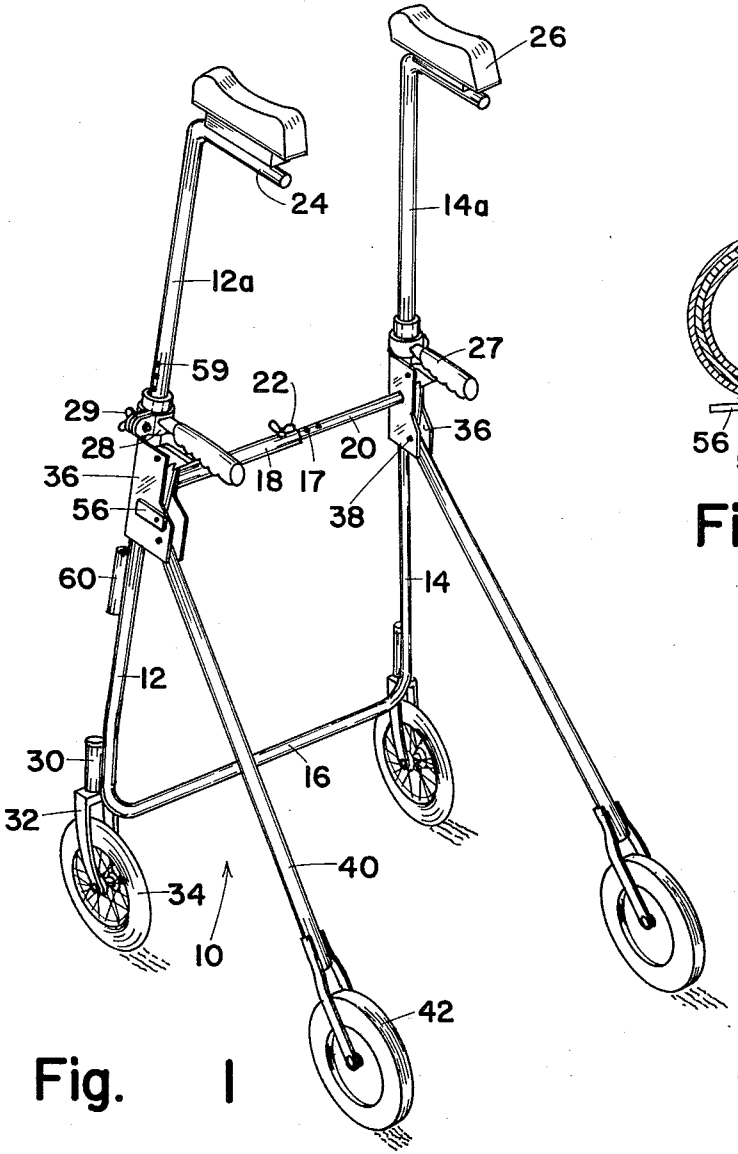
FIG. 1 is a view in perspective of the invalid walker of this invention.

As shown, the columns 12 and 14 may be made of two telescopic sections with upper tubular portions **12*a* and 14*a* being slidable in the columns 12 and 14 for height adjustment. When the proper height is selected, a small pin 54, which is carried on a flexible finger 56 secured at 58 to the U-shaped bracket 36 (FIG. 3) is snapped through aligned holes 59 in the sections 12 and 12*a* (and 14 and 14*a*) to lock it in place. For post-operative hospital use, a tube 60 adapted to receive a post (not shown) of an I.V. assembly may be secured to a column 12 or 14**, or both.

In use, the height of each columns 12, 14 is adjusted so that crutch shoulder supports 26 can carry a substantial portion of the weight of the user while allowing him to propel himself over the surface on which he is moving. The columns 12 and 14 are tilted slightly back, and trailing wheels 42 are spaced from the front wheels 34 so that the user's center of gravity is over the area defined by the "footprints" of the wheels 34 and 42 as they contact the ground.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. An invalid walker comprising:

a U-shaped frame including a bottom cross member and a pair of upright posts;

a front wheel carried on the lower portion of each of said posts;

crutch shoulder support members mounted on the upper ends of said posts;

handgrips extending rearward from said posts intermediate the heights thereof;

rearwardly opening channel member means secured to each post intermediate the height thereof and below said handgrips;

trailing legs having rear wheels on one end portion thereof with the other end portion pivotally connected between said channel member means to enable them to be pivoted between an extended trailing position with the rear wheels disposed a considerable distance rearward of said posts to support the user and a collapsed position wherein they are disposed along and closely adjacent the lower rear portion of said posts;

the other end portion of said trailing legs having integral stop extensions on said trailing legs angling upward therefrom to engage the rear of said posts so as to limit the pivoting of said trailing legs when said extended trailing position has been reached;

the sides of said channel member means engaging said stop extensions when said trailing legs are in their extended position to act as restraining members so as to prevent lateral movement thereof; and latch means on the upper portions of said channel member means engageable over the upper ends of said stop extensions to secure said trailing legs in their extended positions.

2. The invalid walker defined by claim 1 including:

means for adjusting the height of said posts.

3. The invalid walker defined by claim 2 including:

separate adjustment means for fixing the position of said handgrips along said posts.

4. The invalid walker defined by claim 1 wherein:

said trailing legs are free of interconnected members rearward of said post.

5. The invalid walker defined by claim 1 including:

a rotary bearing secured to the lower portion of each of said posts;

said front wheels being of the caster type rotatably mounted in said bearings.

6. The invalid walker defined by claim 1 wherein:

the bottom cross member of said U-shaped frame is relatively long to maximize spacing of said front wheels; and the material of said frame is sufficiently flexible to enable said upright posts to be flexed toward and away from each other to vary the spacing between said shoulder support members;

and including:

interengaging lateral adjustment members on said posts intermediate the height thereof;

releasable means engaging said adjustment members for fixing the total length thereof.

7. The invalid walker defined by claim 1 wherein said channel member means are U-shaped brackets opening to the rear.

* * * * *